US007192262B2

(12) United States Patent
Rippl et al.

(10) Patent No.: US 7,192,262 B2
(45) Date of Patent: Mar. 20, 2007

(54) TWIN-SHAFT VACUUM PUMP AND METHOD OF FORMING SAME

(75) Inventors: Christopher-Mark Rippl, Wetzlar (DE); Juergen Wagner, Mueschenbach (DE)

(73) Assignee: Pfeiffer Vacuum GmbH, Asslar (DE)

( * ) Notice: Subject to any disclaimer, the term of this patent is extended or adjusted under 35 U.S.C. 154(b) by 144 days.

(21) Appl. No.: 10/752,064

(22) Filed: Jan. 6, 2004

(65) Prior Publication Data

US 2005/0276713 A1 Dec. 15, 2005

(30) Foreign Application Priority Data

Jan. 8, 2003 (DE) ..... 103 00 203

(51) Int. Cl.
*F03C 2/00* (2006.01)
*F04C 2/00* (2006.01)

(52) U.S. Cl. ..... 418/201.3; 418/201.1; 418/200

(58) Field of Classification Search ..... 418/201.1, 418/201.3, 206.1, 206.5, 199, 200
See application file for complete search history.

(56) References Cited

U.S. PATENT DOCUMENTS 185,850 A * 1/1877 Cleveland ..... 418/200
3,272,140 A * 9/1966 Curry et al. ..... 418/200
4,761,125 A 8/1988 Inagaki et al.
5,092,751 A * 3/1992 Viktora ..... 418/200
5,755,566 A * 5/1998 Marsillo et al. ..... 418/200

FOREIGN PATENT DOCUMENTS

| | | |
|---|---|---|
| DE | 0693372 | 6/1940 |
| DE | 1021721 | 8/1953 |
| DE | 0914886 | 6/1954 |
| DE | 2302902 | 1/1974 |
| EP | 0546281 | 6/1993 |
| EP | 0995879 | 4/2000 |
| EP | 1026399 | 8/2000 |
| GB | 0564309 | 9/1944 |
| GB | 0795774 | 3/1954 |
| GB | 1181460 | 2/1970 |
| GB | 2030227 | 4/1980 |

OTHER PUBLICATIONS

Patent Abstract of Japan, JP-06101671, Apr. 1994.
Patent Abstracts of Japan JP 04 058093, Feb. 1992.
Patent Abstracts of Japan JP 58 041634, Mar. 1983.

* cited by examiner

*Primary Examiner*—Theresa Trieu
(74) *Attorney, Agent, or Firm*—Abelman, Frayne & Schwab

(57) ABSTRACT

A twin-shaft vacuum pump includes two shafts and two rotors supported on respective shafts and cooperating with each other for producing a pumping effect, with each rotor being formed of a plurality of discoid components.

18 Claims, 9 Drawing Sheets

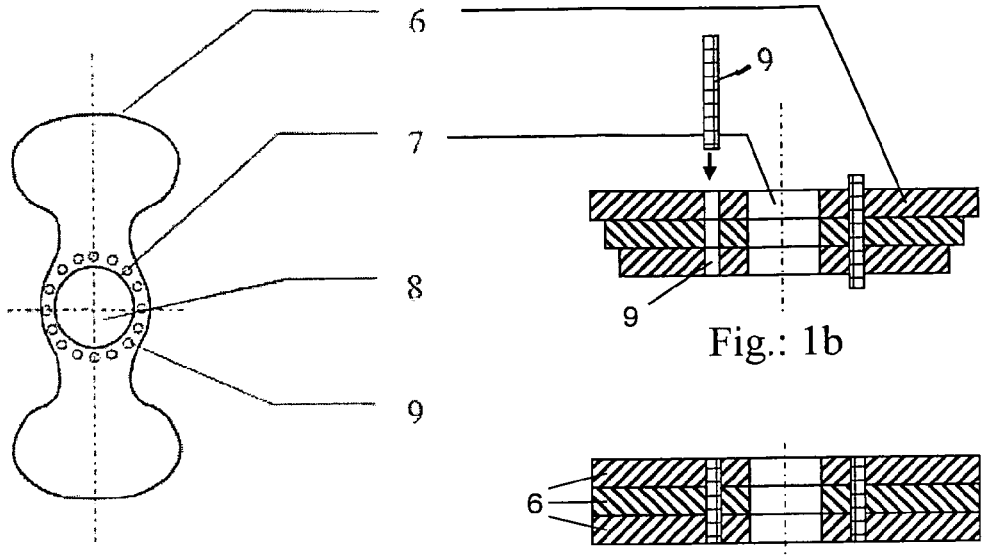
Fig.: 1a
Fig.: 1b
Fig.: 1c
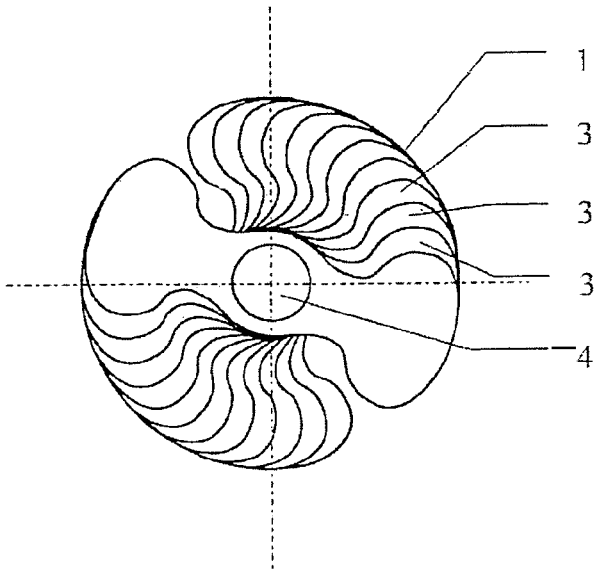
Fig.: 2 a)

b)

TWIN-SHAFT VACUUM PUMP AND METHOD OF FORMING SAME

BACKGROUND OF THE INVENTION

1. Field of Invention

The present invention relates to a twin-shaft vacuum pump and a method of producing or forming the same.

2. Description of the Prior Art

Multi-shaft vacuum pumps such as, e.g., screw pumps are widely used in dry pump systems, in particular, in chemical industry and in semiconductor technology. They consist essentially of a housing with two, crossing each other bores, and two helical rotors arranged in respective bores and rotatable in opposite directions. The two rotors are intermeshing roll over each other in a contactless manner. The cooperation of the two rotors produces a pumping action. The to-be-delivered gas is sucked through an inlet at one side of the rotors and is displaced axially toward the outlet. Due to the decreasing pitch of the screw thread from the inlet to the outlet, compression of the gas takes place.

At a present state of the art, the rotors are formed as one-piece members. The rotors should be formed with a very high precision in order to achieve their effective behavior. For producing of the rotors, five-axes machine-tools should be provided. Both the manufacturing of the rotors and their testing is time-consuming and expensive. In order to reduce manufacturing costs, certain deviations from an ideal profile were accepted. However, the drawback of this consists in high back flow losses. The manufacturing possibilities significantly influence the shape of the helical profile (screw profile).

The use-oriented adaptation results in a change of the screw profile of the rotor and, therefore, influences programming of the machine-tools and, eventually, selection of an appropriate tool or tools.

In particular, within the scope of the development of a pump, many adaptations are required. This results in high expenditure of time and high manufacturing and testing costs.

A further drawback of the conventional pumps consists in that the selection of materials is limited because of a need to take into consideration machining properties of the material.

Accordingly an object of the present invention is to provide twin-shaft vacuum pumps with rotors which can be produced by a simple and cost-effective manufacturing process and which, at the same time, meet the requirements with respect to their precision and testing.

Another object of the present invention is to provide twin-shaft vacuum pumps with rotors which permit an adaptation of their profile to the requirements of their particular use.

A further object of the present invention is to provide twin-shaft vacuum pumps with rotors which permit to increase the material selection the rotors can be formed of.

A still further object of the present invention is a simple and cost-effective process of manufacturing of rotors of twin-shaft vacuum pumps.

SUMMARY OF THE INVENTION

These and other objects of the present invention, which will become apparent hereinafter, are achieved by providing a twin-shaft vacuum pump including two shafts and two rotors which are supported on the two shafts, respectively, cooperate with each other to produce a pumping action, and are formed of a plurality of discoid components.

The method of forming a twin-shaft vacuum pump includes stamping and forming of discoid components having a predetermined shape; forming two rotors by mounting a predetermined plurality of the discoid components on two shafts, respectively, with a predetermined angular offset of the discoid components relative to each other; and securing the plurality of the discord components on respective shafts; and mounting the two rotors in a housing. By forming the rotors of twin-shaft vacuum pumps of separate discoid components, time-consuming and expensive machining processes are eliminated. The discoid components, the rotors are formed of, can be produced by a relatively cost-effective process, e.g., stamping.

Advantageously, the discoid components are angularly offset relative to each other in a rotational direction, which permits to form rotors with a screw profile.

As already discussed above, the discoid components land themselves to manufacturing by a very simple and very cost-effective shaping process.

Dependent on the use, the discoid components can be offset relative to each by the same or different angles. When the discoid components are offset relative to each other by the same angle, the screw threads have uniform pitch. When the discoid components are offset relative to each other by different angles, the reduction of the pitch of the screw threads from the inlet of the pump to its outlet provides for compression of gases. The angular offset can be partially different or completely different.

The rotors of a twin-shaft vacuum pump can be formed as a one-flighted, two-flighted, or multiple-flighted screw. The selection depends on requirements of a particular use of the pump. The rotors according to the present invention can be used in all types of screw pumps.

According to an advantageous embodiment of the present invention, the discoid components are offset relative to each other at a reproducible angle. As the present invention primarily relates to a twin-shaft vacuum pump, it is necessary that the angular offset be reproduced with high precision in order that the screw rotors, which rotate in opposite directions, intermesh with each other and roll over each other in a contract-free manner.

The discoid components, according to the invention can be aligned one beneath the other, i.e., the angular offset of one component is aligned according to an adjacent component. It is also possible to set the angular offset with respect to the shaft the discoid components are supported on. This prevents addition of the angular errors.

The discoid components can be arranged on a shaft immediately adjacent to each other or spaced from each other. In order to insure a contact-free roll-over of the screw rotors relative to each other, according to the invention, adjacent discoid components are spaced from each other in the axial direction. The distance between adjacent discoid components can be, e.g., of an order of one/tenth mm.

In order to maintain the spacing between the adjacent components, a spacer is provided therebetween. Advantageously, the spacer is formed a one-piece with the discoid component. As the discoid component is produced by a stamp-shaping process, the spacer is impressed in the discoid component.

It is also possible to form the spacer as a separate part, advantageously, as a disc. Preferably, the spacer is so formed that it covers a portion of the surface of the discoid component.

It is particularly advantageous when the spacer is so formed that it has a surface maximum corresponding to a reference surface of the adjacent discoid component.

According to a further advantageous embodiment of the present invention, each discoid component has, on its opposite sides, a gear with an inner toothing and a gear with an outer toothing, respectively, with the outer toothing gear of one discoid component engaging the inner toothing gear of an adjacent discoid component.

The use of gears with inner and outer toothings permits to precisely offset the discoid components relative to each other in a reproducible manner. The magnitude of the offset can be easily selected, with the offset being determined by displacement by one or several teeth of the gear.

According to a particular advantageous embodiment of the present invention, a height of the outer toothing gear is greater than the depth of the inner toothing gear. As a result, when the outer toothing gear of one discoid component engages in the inner toothing gear of an adjacent component, the two adjacent components are spaced from each other, and an additional spacer is not any more necessary.

Instead of using gears for offsetting the discoid components relative to each other, a ring of holes can be formed in the discoid components around their respective shaft-receiving openings, with the holes being circumferentially equidistantly spaced from each other and radially equidistantly spaced from the shaft-receiving opening. During mounting of the discoid components on a shaft, care should be taken that the holes are superimposed over each other or coincide with each other. For securing the discoid components, e.g., pins, ropes, or, preferably, stable wire cords are inserted through the superimposed holes.

According to still another embodiment of the present invention, the shafts are formed as spline shafts, and the discoid components have their shaft-receiving openings provided with a corresponding inner toothings formlockingly engaging the spline shafts. The discoid components can be offset relative to each other by changing positions of the discoid components relative to each other on the shaft.

According to a still further advantageous embodiment of the present invention, the discoid components have at least one of projections and grooves. The projections are so formed that the projections of one of the component abut an adjacent component. The provision of projections permits to obtain a predetermined spacing between adjacent discoid components. Advantageously, the projections also insure sealing of the adjacent components relative to each other, leaving no intermediate space between the discoid components through which the pumped gas can penetrate.

Advantageously, the projections and/or grooves are formed in the region of the outer contour of the discoid components.

Advantageously, the projections are formed during the discoid component shaping process. During the shaping process, the projections on a side of a discoid component are formed as a result of forming of appropriate grooves on the opposite side of the discoid component.

It is advantageous when a discoid component is formed as a one-piece member. This insures a most cost-effective manufacturing of discoid components.

Generally, it is possible to form identical discoid components for one or both rotors. This again insures a substantial reduction of manufacturing costs.

The rotors are mounted in the pump housing having a corresponding shape.

In a particular case, it is possible to mount the discoid components on a shaft, without them being offset relative to each other. In this case, the rotor is used as a rotor for a roots type pump.

The process or method of forming a twin-shaft vacuum pump according to the present invention has already been described above. According to a modified process, the rotors are arranged, after mounting of the discoid components on the shafts, in a reverse form corresponding to the outer profile of the rotors in order to align the discoid components.

The inventive twin-shaft vacuum pump has the following advantages:

- it is very simple to manufacture,
- the discoid components can be formed using a stamping process,
- because of use of many identical parts, the manufacturing costs are reduced,
- the material of the rotor components, i.e., of the rotor can be freely selected, which permits to produce rotors from a high-quality stainless steel,
- the graduation (pitch) and the suction capacity can be freely selected,
- it is possible to combine roots stages with piston stages (rotary pumps with integrated atmospheric stages as a substitute for pump stands),
- during the development phase, different pitches with sample parts can be tested, without a need to produce new parts,
- the pump system can quickly be adapted, without manufacturing expenses, to new applications (a new assembly of the same pump),
- the profile shape can be freely selected (roll-over condition in a plane).

The novel features of the present invention, which are considered as characteristics for the invention, are set forth in the appended claims. The invention itself, however both as to its construction and its mode operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 1*a* a plan view of a discoid component for forming a rotor of a twin-shaft vacuum pump according to the present invention;

FIG. 1*b* an axial cross-sectional view through a stack of discoid components, such as shown in FIG. 1*a*, with the discoid components being angularly offset relative to each other;

FIG. 1*c* a view similar to that of FIG. 1*b* but with the discoid components having no angular offset relative to each other;

FIG. 2 a plan view showing an arrangement of a plurality of discoid components shown in FIG. 1 on a shaft, with the discoid components being angularly offset relative to each other;

DETAILED DESCRIPTION OF THE PREFERRED EMBODIMENTS

FIG. 2 shows a rotor 1 for twin-shaft vacuum pump according to the present invention and which is supported on a shaft 4. The rotor 1 is formed of a plurality of discoid components 3 offset relative to each other by the same angle.

Figure 3:
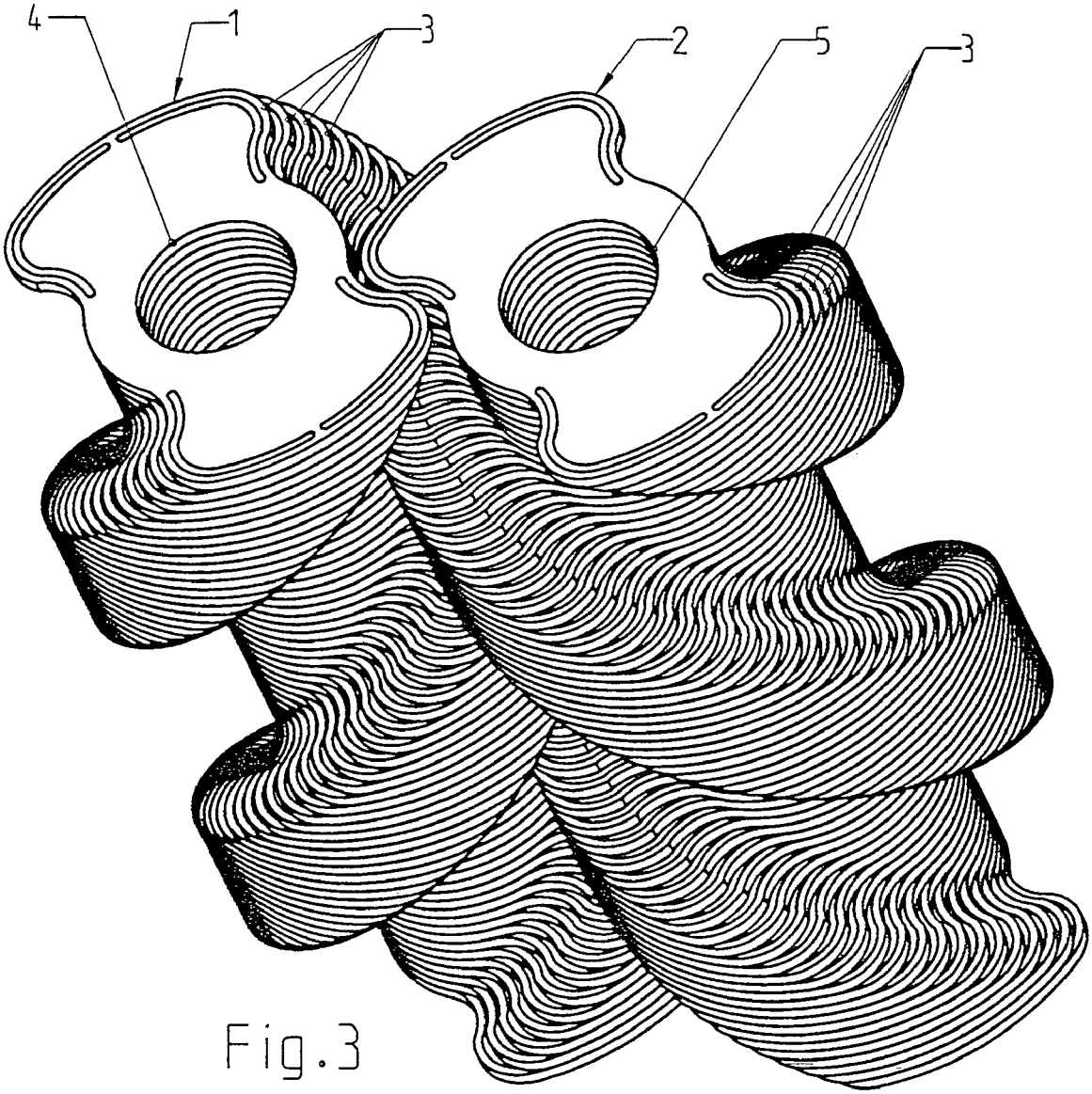
FIG. 3 a perspective view of two rotors of a twin-shaft vacuum pump according to the present invention and which are formed of discoid components shown in FIG. 1.

FIG. 3 shows two rotors 1 and 2 supported, respectively, on two shafts 4 and 5 of a twin-shaft vacuum pump. The rotor 2 is formed, as the rotor 1 shown in FIG. 2, of discoid components 3 likewise offset relative to each other at the same angle. With the components 3 of each rotor 1, 2 being offset relative to each other in a rotational direction of the rotors 1, 2, an outer profile of the rotors 1, 2 has a helical shape.

The component 3, of which the rotors 1 and 2 are formed, is shown in FIG. 1*a*. The component 3 is formed as a discoid member 6 having a receiving opening 7 for receiving a shaft 8 which extends therethrough. The receiving opening 7 is surrounded by a ring of holes 9. Upon forming a rotor of the discoid members 6, with the members 6 being angularly offset relative to each other, the holes 9 of the members 6 coincide with each other (as shown in FIG. 1*b*), which permits to insert appropriate pins 9' therethrough. With the pins, the discoid members are secured with each other at a predetermined angle to each other. Because of the angular offset of the discoid components or members 6 in FIG. 1*b*, they appear to have different diameters. FIG. 1*c*shows discoid members 6 without being angularly offset relative to each other.

Figure 4:
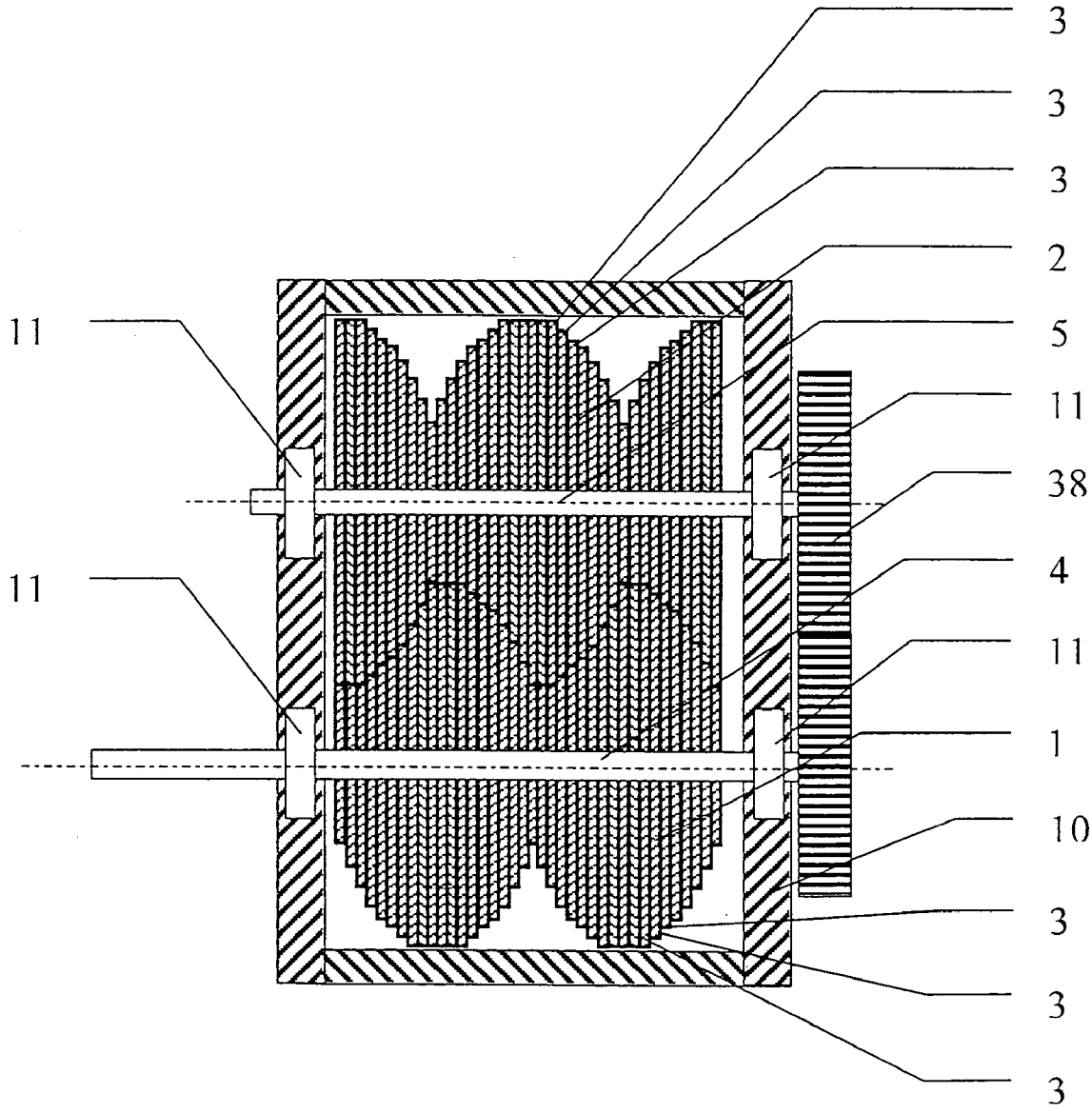
FIG. 4 a cross-sectional view showing an arrangement of two screw rotors in a housing of a vacuum pump according to the present invention.

FIG. 4 shows an arrangement of the shafts 4, 5 with the rotors 1, 2 mounted thereon in a pump housing 10. The shafts 4 and 5 are supported in the housing 10 in respective bearings 11. A drive 38 synchronizes the rotation of the two shafts 4, 5.

Figure 5:
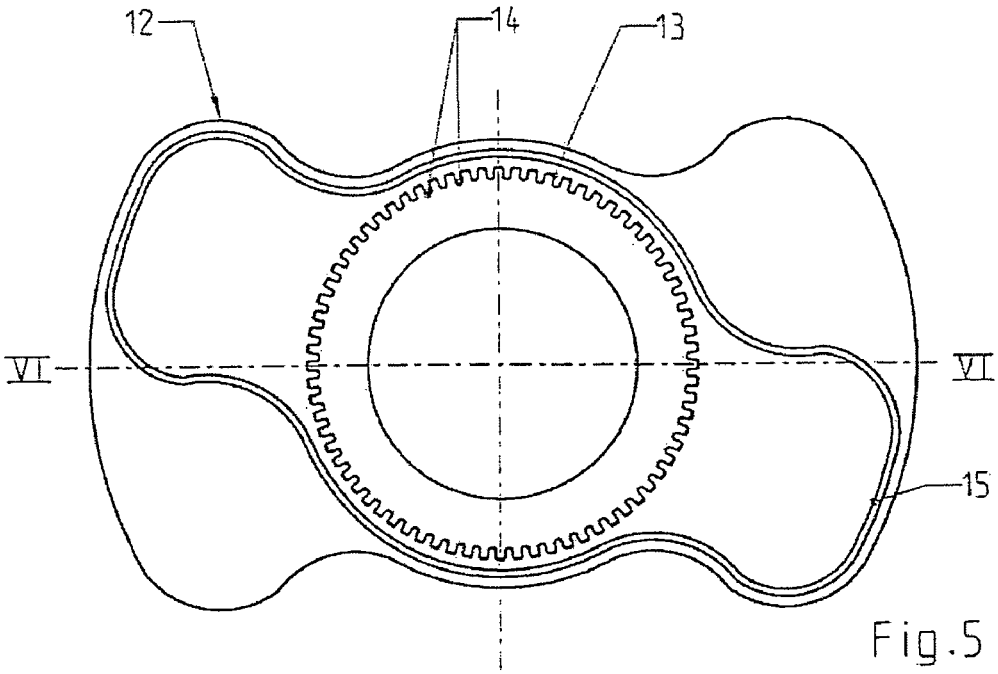
FIG. 5 a bottom view of a discoid component for forming a rotor of a twin-shaft vacuum pump according to the present invention and including gears with outer and inner toothings, respectively.

FIG. 5 shows a discoid component 12 that is provided in its bottom side with gear 13 provided with an outer toothing, and on its upper side with a gear 14 having an inner toothing.

Figure 6:
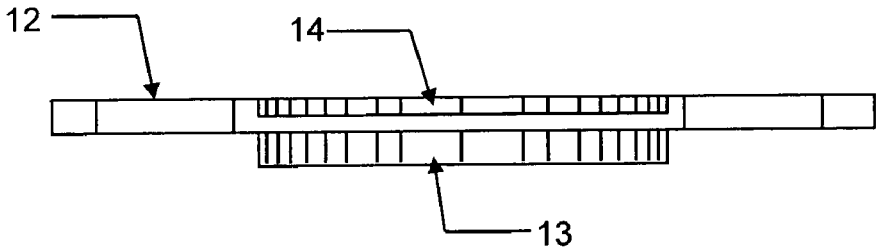
FIG. 6 a cross-sectional view along VI—VI in FIG. 5.

As can be seen in FIG. 6, the outer toothing of the gear 13 projects from the bottom or base surface of the component 12, whereas the inner toothing of the gear 14 is formed as a recess in the component 12. As can be seen in FIG. 6, the height of the outer toothing gear 13 is greater than the depth of the gear 14.Upon forming a rotor of the discoid components, the outer toothing of the gear 13 of one component 12 engages in the inner toothing of the gear 14 of an adjacent component 12. As shown in FIG. 5, the discoid component 12 has a circumferential bead 15 that abuts a surface of an adjacent component 12 upon the components 12 being assembled on a shaft. The beads 15 of the discoid components 12 seal adjacent components 12 with respect to each other.

Figure 7:
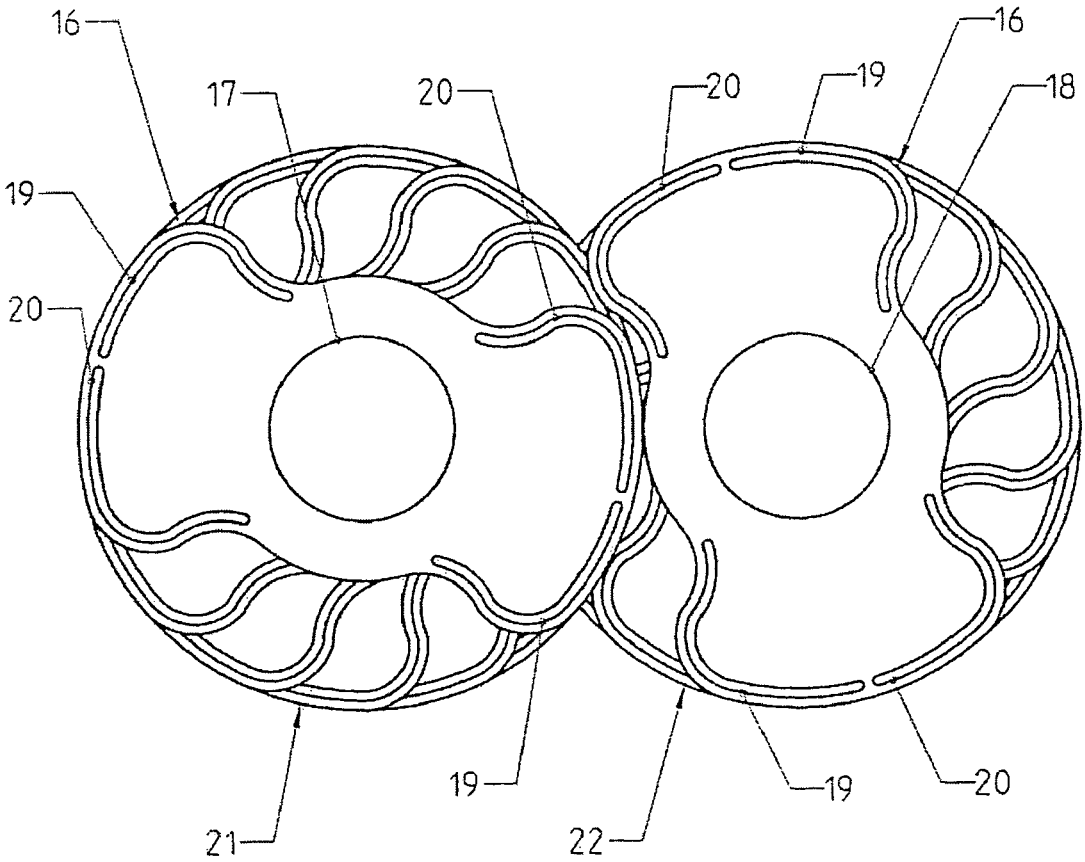
FIG. 7*a* a front view showing engagement of two rotors formed of discoid components.
FIG. 7*b* a side view showing arrangement of discoid components on a shaft.
Figure 7:
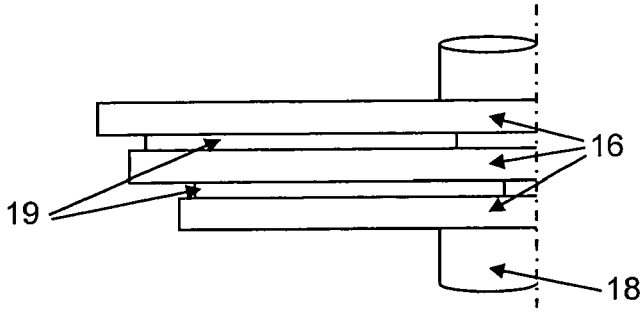

FIG. 7*a* shows arrangement of discoid components 16 on shafts 17, 18 for forming respective rotors. Each of the components 16 has projections 19 and grooves 20. When a discoid component 16 is divided in quadrants, in respective, diametrically opposite quadrants, either projections 19 or grooves 20 are provided. As shown in FIG. 7*b*, the projections 19 have a predetermined height so that they can abut respective adjacent components 16. Thereby, upon a contactless rolling-over of the rotors 21, 22 relative to each other, the projections 19 of the components 16 of the rotor 21 do not prevent the engagement of the components 16 of the rotor 22.

Figure 8:
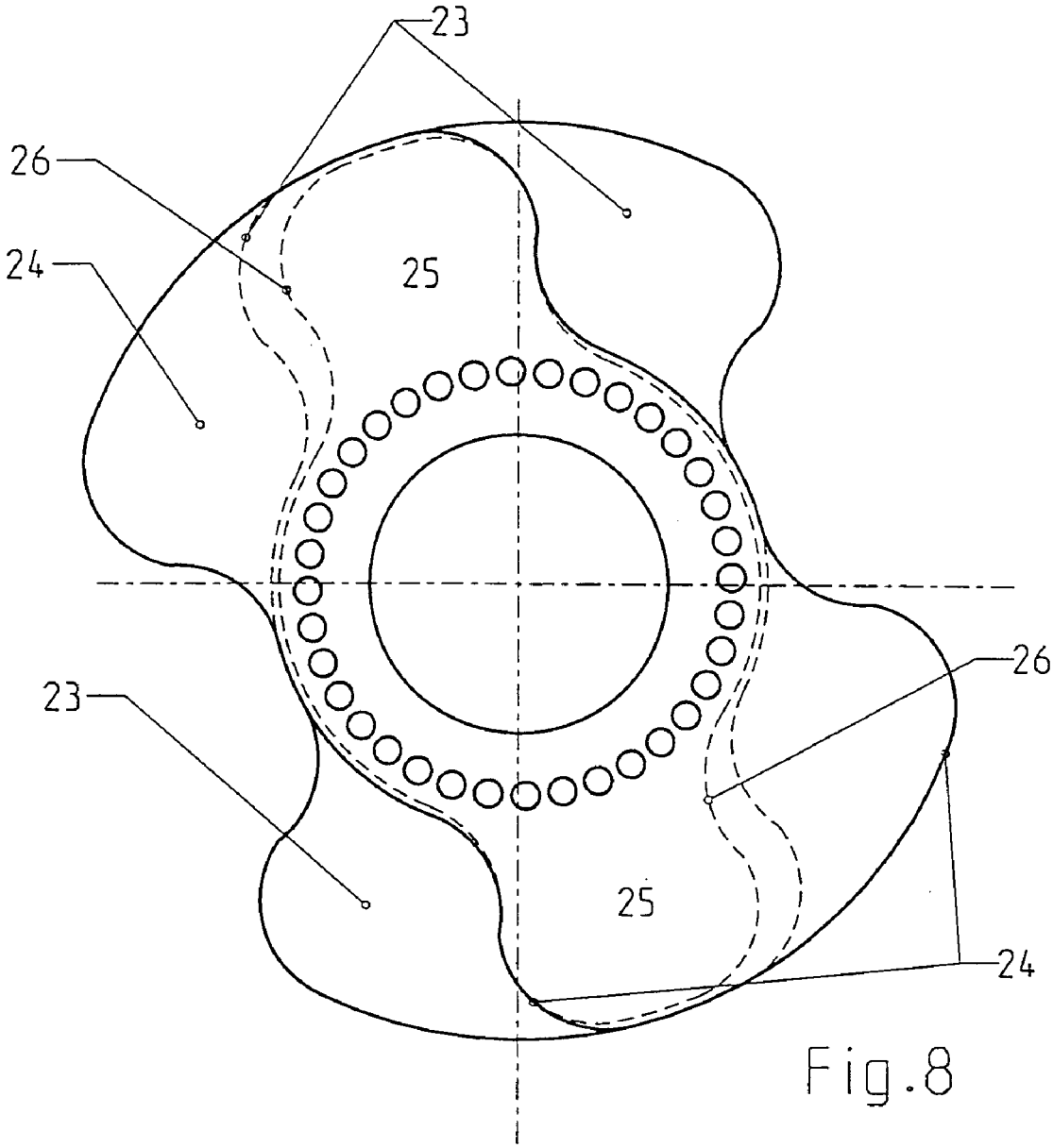
FIG. 8 a plan view of two discoid components angularly offset relative to each other and axially separated by a spacer.

FIG. 8 shows two discoid components 23, 24 offset relative to each other at an angle of 30°. The two components 23, 24 overlap a common surface 25. In the overlapping region, no elements of oppositely located discoid components of adjacent rotors engage each other, and a spacer 26, which lies in the common surface 25, does not prevent a contactless rolling-over of the two adjacent rotors relative to each other.

Figure 9:
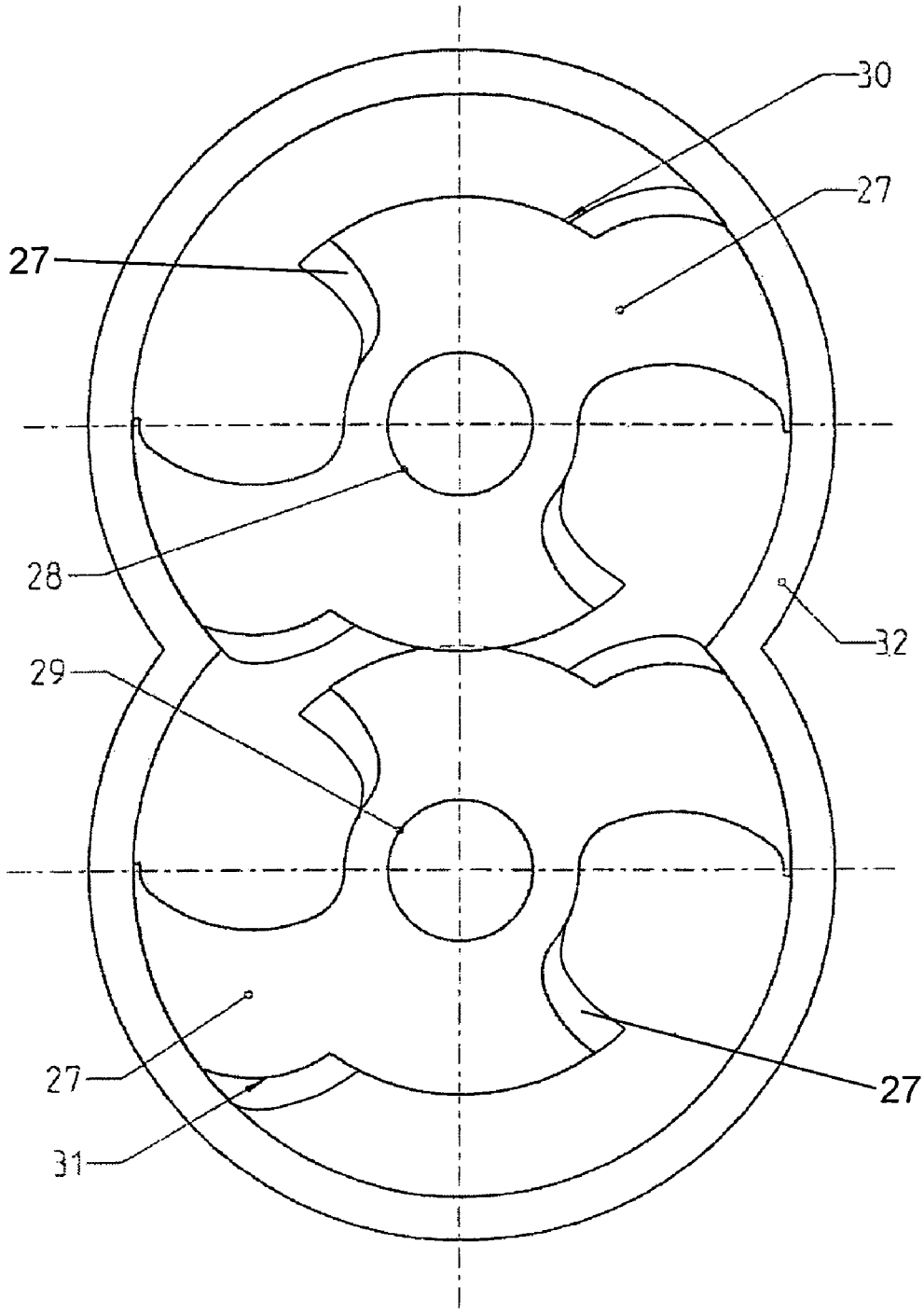
FIG. 9 a plan view of another embodiment of a discoid component for forming a rotor of a twin-shaft vacuum-pump according to the present invention.

FIG. 9 shows four discoid components 27 supported on respective shafts 28, 29 and offset relative to each other. The discoid components 27 form two rotors 30, 31 supported on respective shafts 28, 29 located in a housing 32. The discoid components 27 are so formed that, upon assembly of the rotors, with an angular offset of the components 27, a double-lead pump is formed.

Figure 10:
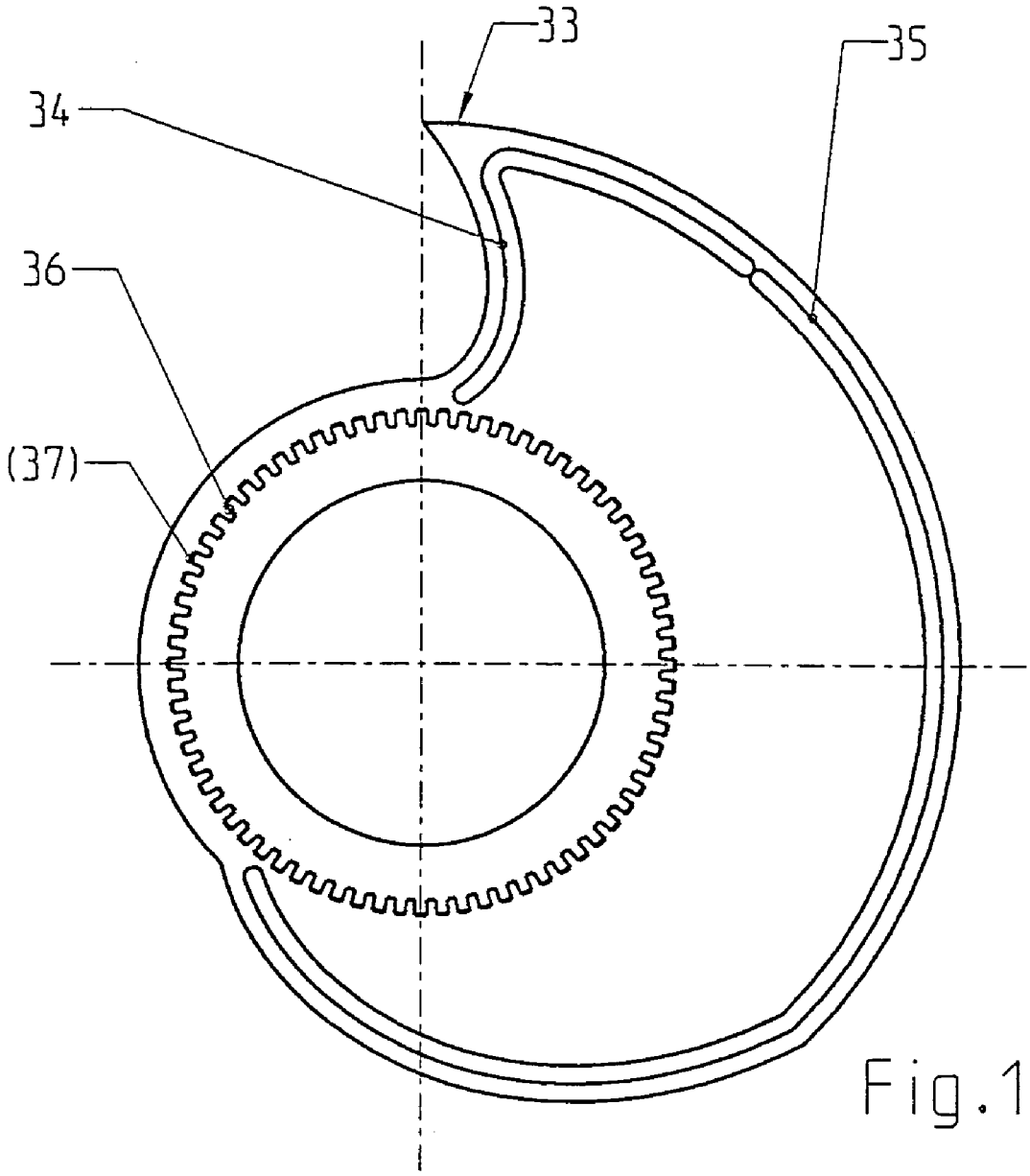
FIG. 10 a plan view of a still further embodiment of a discoid component for forming a rotor for a single-flight screw pump.

FIG. 10 shows a discoid component 33 for a single-flight or single-lead pump. The component 33 is provided with grooves 34 and projections 35, and with a gear 36 provided on an upper surface of the component 33. On an opposite, bottom side of the component 33, there is provided a gear 36 complementary to the gear 37.

Figure 11:
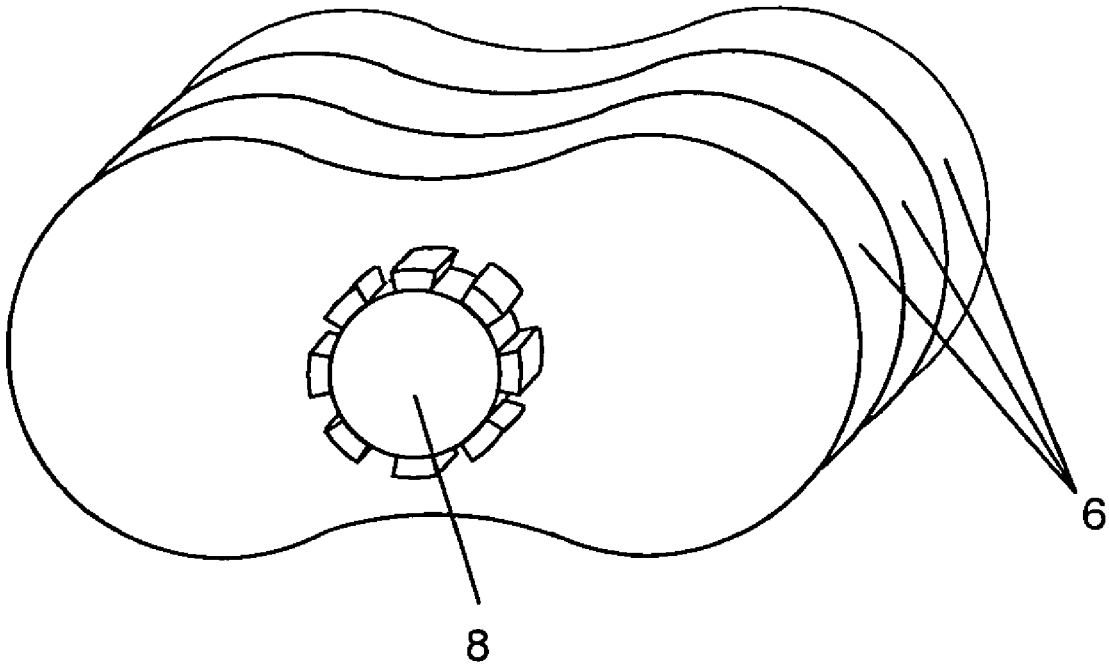
FIG. 11 a schematic perspective view showing mounting of discoid components on a spline shaft.

FIG. 11 shows mounting of discoid components 6 on a spline shaft 11.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A twin-shaft vacuum pump, comprising two shafts; and two rotors supported on the two shafts, respectively, and cooperating with each other for producing a pumping action, each of the rotors being formed of a plurality of discoid components, wherein a spacer is provided between each two adjacent discoid components, and wherein the spacer is formed as a discoid element that overlaps a portion of a surface of a discoid component.

2. A twin-shaft vacuum pump as set forth in claim 1, wherein an outer profile of each pump is formed by the discoid components which are supported on respective shaft.

3. A twin-shaft vacuum pump as set forth in claim 1, wherein the discoid components are arranged on a respective shaft at a same angle to each and are offset relative to each other in a rotational direction of the shaft, forming a helical outer profile of the rotor.

4. A twin-shaft vacuum pump as set forth in claim 1, wherein each rotor has a profile of a single-lead screw.

5. A twin-shaft vacuum pump as set forth in claim 1, wherein each rotor has a profile of a multiple-lead thread.

6. A twin-shaft vacuum pump as set forth in claim 1, wherein the spacer is formed as one-piece with a discoid component.

7. A twin-shaft vacuum pump as set forth in claim 1, wherein a discoid component has a ring of holes around a shaft-receiving opening thereof, and wherein the holes are circumferentially equidistantly spaced from each other and are radially equidistantly spaced from the shaft-receiving opening.

8. A twin-shaft vacuum pump as set forth in claim 7, wherein with the plurality of discoid components being mounted on a respective shaft, the holes of the components coincide with each other and are interspersed with appropriate pins which fixedly connect the plurality of the rotor-forming components.

9. A twin-shaft vacuum pump as set forth in claim 1, wherein the shafts are formed as spline shafts, and the discoid components have their shaft-receiving openings provided with a corresponding inner toothings formlocking engaging the spline shafts.

10. A twin-shaft vacuum pump as set forth in claim 1, wherein the discoid components are formed as one-piece members.

11. A twin-shaft vacuum pump as set forth in claim 1, wherein the discoid component of at least one of the rotors are identical.

12. A twin-shaft vacuum pump as set forth in claim 1, wherein the shafts, together with the rotors, are arranged in a pump housing.

13. A twin-shaft vacuum pump as set forth in claim 1, wherein the discoid components are mounted on respective shafts without an angular offset relative to each other.

14. A twin-shaft vacuum pump, comprising two shafts; and two rotors supported on the two shafts, respectively, and cooperating with each other for producing a pumping action, each of the rotors being formed of a plurality of discoid components, wherein each discoid component has, on opposite sides thereof, a gear with an inner toothing and a gear with an outer toothing, respectively, with the outer toothing gear of one discoid component engaging the inner toothing gear of an adjacent discoid component.

15. A twin-shaft vacuum pump as set forth in claim 14, wherein height of the outer toothing gear is greater than a depth of the inner toothing gear.

16. A twin-shaft vacuum pump, comprising two shafts; and two rotors supported on the two shafts, respectively, and cooperating with each other for producing a pumping action, each of the rotors being formed of a plurality of discoid components, wherein the discoid components have each at least one of projections and grooves, and wherein the projections have a height such that they abut respective adjacent discoid components.

17. A twin-shaft vacuum pump as set forth in claim 16, wherein the at least one of projections and grooves are provided in a region of an outer contour of the discoid components.

18. A twin-shaft vacuum pump, comprising two shafts; and two rotors supported on the two shafts, respectively, and cooperating with each other for producing a pumping action, each of the rotors being formed of a plurality of discoid components, wherein the discoid components have both projections and grooves, with the projections being formed on one side of a discoid component as a result of formation of the grooves on an opposite side of the discoid component.

* * * * *